United States Patent [19]

Lemahieu et al.

[11] 4,092,168

[45] May 30, 1978

[54] LIGHT-ABSORBING DYES FOR SILVER HALIDE MATERIAL

[75] Inventors: Raymond Gerard Lemahieu; Henri Depoorter, both of Mortsel; Willy Joseph Vanassche, Kontich, all of Belgium

[73] Assignee: Agfa-Gevaert, N.V., Mortsel, Belgium

[21] Appl. No.: 751,969

[22] Filed: Dec. 17, 1976

[30] Foreign Application Priority Data

Jan. 16, 1976 United Kingdom ..... 1797/76

[51] Int. Cl.[2] ..... G03C 1/84

[52] U.S. Cl. ..... 96/84 R; 96/126; 252/300

[58] Field of Search ..... 96/84 R, 126, 2, 84 UV; 252/300

[56] References Cited

U.S. PATENT DOCUMENTS

| | | | |
|---|---|---|---|
| 3,502,474 | 3/1970 | Tsuda et al. | 96/84 R |
| 3,647,460 | 3/1972 | Hofman | 96/84 R |
| 3,652,280 | 3/1972 | De Belder et al. | 96/64 |
| 3,847,621 | 11/1974 | Nishina et al. | 96/126 |

*Primary Examiner*—John D. Welsh
*Attorney, Agent, or Firm*—A. W. Breiner

[57] ABSTRACT

Novel antihalation layer(s) for use in a light-sensitive silver halide element and comprising a 5-pyrazolone-monomethine oxonol of formula I and a 5-pyrazolone-pentamethine oxonol of formula II :

I.

II.

wherein:

each of $R^1$ and $R^3$ represents an alkyl group or an aryl group, each of $R^2$ and $R^4$ represents an alkyl group, an aryl group or the group COOR wherein R is alkyl or aryl, and each dye molecule contains at least two carboxyl groups in their free acid form and further contains no solubilizing groups.

4 Claims, 1 Drawing Figure

Figure 1:
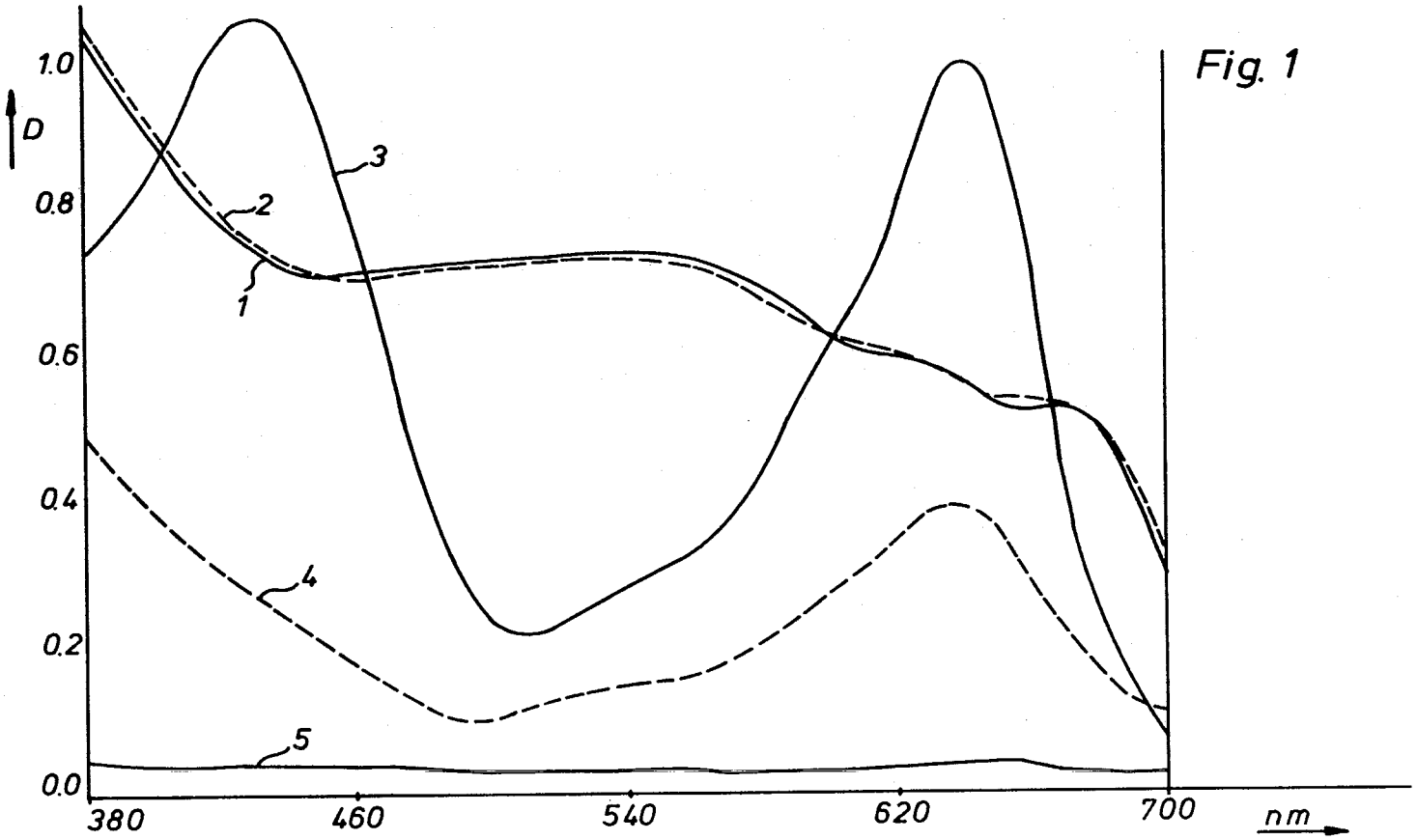

D
1.0
0.8
0.6
0.4
0.2
0.0
380
460
540
620
700
nm
1
2
3
4
5

LIGHT-ABSORBING DYES FOR SILVER HALIDE MATERIAL

The present invention relates to photographic light-sensitive silver halide materials comprising a combination of light absorbing dyes for the whole visible region of the spectrum.

It is known, for many purposes, to incorporate light absorbing dyes into photographic elements. Such light absorbing dye may be used as filter dye in a layer coated over one or more light-sensitive emulsion layers or between two emulsion layers e.g. different colour sensitized emulsion layers, to protect the underlying light-sensitive emulsion layer(s) from the action of light of a wavelength range absorbed by such light absorbing dye; as screening dye in a light-sensitive emulsion layer itself or as antihalation dye in a layer not containing a light-sensitive substance known as antihalation layer, situated on either side of the support carrying the light-sensitive emulsion layer(s).

The spectral absorption range of the dyes used should correspond to the spectral sensitivity range of the light-sensitive emulsion in view of which they are used. For panchromatically sensitized emulsion layers it is common practice to use in antihalation layers or in said emulsion layers a combination of dyes so chosen as to absorb light of the whole visible region of the spectrum. To obtain as much as possible a uniform absorption within this region multiple dyes with different absorption ranges are used.

Apart from the fact that for these purposes it may be difficult to match the individual absorption characteristics of the dyes, each of the dyes used should meet the specific requirements for their use in photographic elements e.g. they should not affect the inherent or spectral sensitivity of the light-sensitive emulsions with which they may come into contact, they should not give rise to fogging, and they should be readily rendered ineffective e.g. decolourized or destroyed and removed in one of the processing stages. Moreover, using a multiplicity of dyes poses compatibility problems and may increase coating deficiencies.

Among the light-absorbing dyes that have been proposed for use in photographic elements the pyrazolon-oxonols are well known representatives.

In accordance with the present invention for absorbing light of the whole visible spectral region, more particularly of the region from about 380 nm to about 700 nm, in a silver halide emulsion layer or in an antihalation layer of a photographic material, a combination of a 5-pyrazolone-monomethine oxonol dye of the following formula I and a 5-pyrazolone-pentamethineoxonol dye of the following formula II, is used:

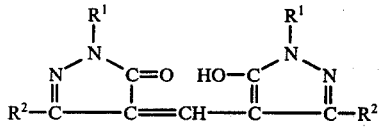

I.

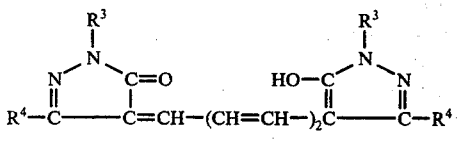

II.

wherein:

each of $R^1$ and $R^3$ represents alkyl, substituted alkyl, aryl, or substituted aryl, each of $R^2$ and $R^4$ represents alkyl, substituted alkyl, aryl, substituted aryl or a COOR group wherein R is alkyl or aryl, and each dye molecule contains at least two carboxyl groups in their free acid form, preferably as substituants on the $R^1$ and $R^3$ groups and each dye molecule is further free of solubilizing groups. By "solubilizing groups" is meant groups rendering the dye soluble in the silver halide emulsion or antihalation coating composition e.g. sulphogroups in acid or salt form, and carboxyl groups in salt form.

Preferred dyes are bis[1-(carboxyphenyl)-3-alkyl-5-pyrazolon]oxonols wherein the carboxy groups are in their free acid form.

As is illustrated in the Example hereinafter the dyes of the above formula when used in dissolved form by conversion of the carboxyl groups and oxonol function in the water-soluble salt form, do not provide uniform absorption over the whole visible region of the spectrum.

Moreover since for covering the whole region of the visible spectrum the number of dyes can be limited according to the present invention, the risk for coating difficulties and desensitizing effects is reduced. In addition thereto, the insoluble dyes used according to the present invention are non-diffusible in hydrophilic colloid layers and thus need not be mordanted by means of mordanting agents which is a must for the highly diffusible corresponding dyes with carboxyl groups in salt form. Nevertheless they are completely removed upon treatment of the light-sensitive silver halide material with an alkaline processing solution e.g. developing solution — even when the dyes are used in an antihalation coating between the support and the emulsion layer(s) — by conversion of the free carboxyl groups and oxonol function in their water-solubilizing salt form which renders the dye molecule highly diffusible.

The present invention thus provides a photographic material comprising a support and at least one light-sensitive silver halide emulsion layer wherein this emulsion layer or an antihalation layer coated on either side of the support comprises a dye combination as defined above.

Representative examples of monomethine and pentamethine dyes for use according to this invention are:

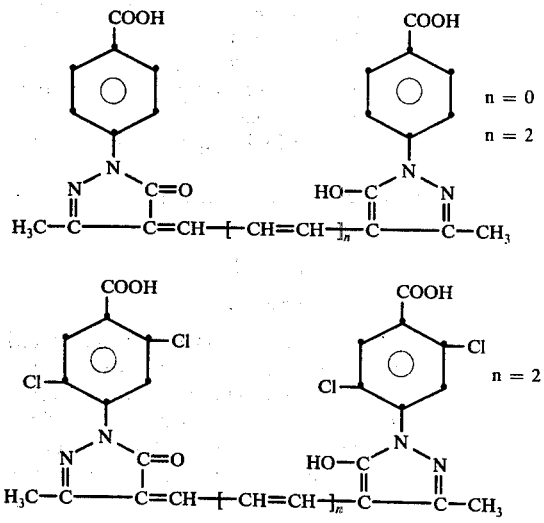

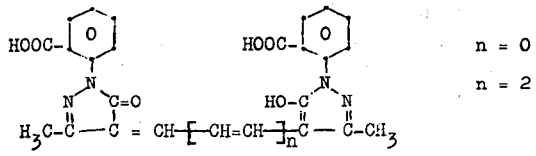

n = 0
n = 2

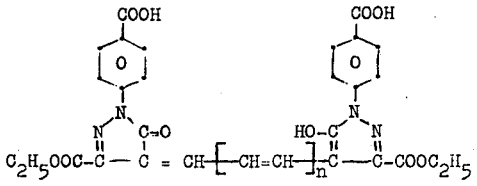

n = 0
n = 2

The dyes can be prepared by methods known to those skilled in the art.

According to a preferred embodiment of the present invention the dye combination is used in an antihalation layer coated between the support and the light-sensitive silver halide emulsion layer(s) of a photographic silver halide material.

The dyes used according to this invention can be incorporated into the light-sensitive silver halide emulsion layer or the non-light-sensitive antihalation layer according to any technique known to those skilled in the art for dispersing water-insoluble compounds in hydrophilic colloid layers.

They can be incorporated in hydrophilic colloid compositions from solutions in water-miscible and/or water-immiscible solvents according to any of the dispersion techniques known for incorporating water-insoluble colour couplers in hydrophilic colloid media.

According to the present invention, it is preferred to prepare a dispersion of the dyes in an aqueous hydrophilic colloid composition by finely grinding the water-insoluble dyes in a mill e.g. ball mill, sand mill or colloid mill in the presence of one or more dispersing agent(s); the hydrophilic colloid e.g. gelatin is added after or before the milling process. The dispersion obtained is then mixed with the coating composition.

It is also possible to use the dyes in their salt form and to convert them in situ in their acid form e.g. by overcoating a gelatin layer containing the dissolved dyes in salt form with an acid gelatin layer so as to convert the dyes in their acid form.

The colloids or mixtures of colloids used in the hydrophilic colloid compositions into which the dyes of the invention are dispersed, may be of any type as commonly used in photographic materials e.g. gelatin, casein, polyvinyl alcohol, poly-N-vinyl pyrrolidone, carboxy methylcellulose or sodium alginate, gelatin being however favoured. Before coating, other ingredients, such as coating aids and hardening agents may be added to the dye dispersions.

The following example illustrates the present invention.

EXAMPLE

Material A 6 g of bis[1-(p-carboxyphenyl)-3-methyl-5-pyrazolon] monomethine oxonol and 2.6 g of bis[1(p-carboxyphenyl)-3-methyl-5-pyrazolon]pentamethine oxonol were mixed with 200 g of "Ottawa-sand", 0.86 of sodium oleyl methyl tauride and a little water, until a high viscous paste was obtained. This mixture was milled in a sandmill for 4 hours, whereupon the mixture was filtered through a glass filter. The sand remaining on the filter was washed with water to remove from the sand particles the adsorbed oxonol dyes.

The filtrate was added to a solution at 36° C of 43 g of gelatin in 387 g of water.

The gelatin dispersion thus obtained was coated on a film support so that 0.282 g of bis[1-(p-carboxyphenyl) 3-methyl-5-pyrazolon]monomethine oxonol, 0.123 g of bis[1-(p-carboxyphenyl)-3-methyl-5-pyrazolon]pentamethine oxonol and 2 g of gelatin were present per sq.m.

The dyed gelatin layer was overcoated with a gelatin antistress containing 5 g of gelatin per sq.m.

Material B

The following solutions were prepared:

A. 21.5 g of gelatin in 250 ml of water

B. 1.3 g of bis[1(p-carboxyphenyl)-3-methyl-5-pyrazolon] pentamethine oxonol dissolved in 122 ml of water containing 7.8 ml of potassium hydroxide 1N C. 3 g of bis[1-p-carboxyphenyl)3-methyl-5-pyrazolon]monomethine oxonol dissolved in 100 ml of water containing 20 ml of potassium hydroxide 1N.

Solutions A, B and C were mixed together and after addition of coating aids, the gelatin solution was coated on a film support so that the coated layer contains per sq.m 2 g of gelatin, 0.126 g of bis[1-(p-carboxyphenyl)-3-methyl-5-pyrazolon]pentamethine oxonol and 0.285 g of bis[1-(p-carboxyphenyl)-3-methyl-5-pyrazolon]-monomethine oxonol. The dyed layer was overcoated with a gelatin antistress layer containing 5 g of gelatin per sq.m.

In the accompanying FIG. I, the absorption curves (density D versus wavelength nm) are given of materials A and B before any treatment of the materials as well as after treatment for 1 min in demineralized water and after a sequence of treatments corresponding to conventional black-and-white processing of exposed photographic material which includes 20 s developement at 38° C, 10 s rinsing, 20 s fixing, 20 s rinsing and 10 s drying.

Curves 1 and 2 are the absorption curves of Material A before and after rinsing with water for 1 min at 20° C.

Curves 3 and 4 are the absorption curves of Material B before and after rinsing with water for 1 min at 20° C.

Curve 5 is the absorption curve of both material A and material B after the processing sequence.

From a comparison of curves 1 and 3 it is apparent that the dye combination according to the invention absorbs all light of the visible wavelength region more uniformly than the dye combination wherein the dyes are used in salt form, the latter dye combination being especially defective for the 460 to 600 nm region.

From a comparison of curves 2 and 4 respectively with curves 1 and 3 respectively it is clearly apparent that the dye combination of the invention is highly resistant to diffusion whereas the dyes when used in their salt form are highly diffusible.

The absorption curve 5 shows that both materials A and B are completely discoloured upon processing.

We claim:

1. A light-sensitive photographic element comprising a support and at least one light-sensitive silver halide emulsion layer wherein the emulsion layer or an antihalation layer coated on either side of the support comprises a 5-pyrazolone-monomethine oxonol of formula I and a 5-pyrazolone-pentamethine oxonol of formula II:

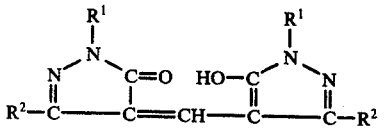

I.

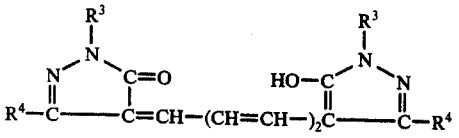

II.

wherein:

each of $R^1$ and $R^3$ represents an alkyl group or an aryl group, each of $R^2$ and $R^4$ represents an alkyl group, an aryl group or the group COOR wherein R is alkyl or aryl, and each dye molecule contains at least two carboxyl groups in their free acid form and further contains no solubilizing groups.

2. An element according to claim 1, wherein the dyes are present in an antihalation coating between the support and the emulsion layer.

3. An element according to claim 1, wherein the dyes are bis[1-(carboxyphenyl)-3-alkyl-5-pyrazolone]oxonol dyes.

4. An element according to claim 1, wherein the emulsion layer is panchromatically sensitized.

* * * * *